US010801341B2

(12) United States Patent
Kumar et al.

(10) Patent No.: US 10,801,341 B2
(45) Date of Patent: Oct. 13, 2020

(54) COOLING FEATURES FOR A GAS TURBINE ENGINE TRANSITION DUCT

(71) Applicant: Siemens Aktiengesellschaft, Munich (DE)

(72) Inventors: Manish Kumar, Charlotte, NC (US); Daniel Cassar, Charlotte, NC (US)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 172 days.

(21) Appl. No.: 16/062,651

(22) PCT Filed: Dec. 15, 2015

(86) PCT No.: PCT/US2015/065750

§ 371 (c)(1),
(2) Date: Jun. 15, 2018

(87) PCT Pub. No.: WO2017/105405

PCT Pub. Date: Jun. 22, 2017

(65) Prior Publication Data

US 2018/0371943 A1 Dec. 27, 2018

(51) Int. Cl.
*F01D 9/02* (2006.01)
*F01D 25/12* (2006.01)

(52) U.S. Cl.
CPC ..... *F01D 9/023* (2013.01); *F01D 25/12* (2013.01); *F05D 2220/32* (2013.01); *F05D 2230/60* (2013.01); *F05D 2240/12* (2013.01); *F05D 2240/35* (2013.01); *F05D 2260/20* (2013.01)

(58) Field of Classification Search
None
See application file for complete search history.

(56) References Cited

U.S. PATENT DOCUMENTS 6,018,950 A * 2/2000 Moeller ..... F01D 9/023 29/889.2
2010/0034643 A1 2/2010 Davis, Jr. et al.
2013/0074502 A1 3/2013 Hada et al.

FOREIGN PATENT DOCUMENTS

EP 3002415 A1 4/2016

OTHER PUBLICATIONS

PCT International Search Report and Written Opinion dated Dec. 15, 2015 corresponding to PCT Application No. PCT/US2015/065750 filed Dec. 15, 2015.

* cited by examiner

*Primary Examiner* — Woody A Lee, Jr.
*Assistant Examiner* — Jason G Davis

(57) ABSTRACT

A gas engine turbine has a transition duct (100) that has improved cooling features and a method for forming the cooling features. A continuous exit section cooling channel (130) is formed through the transition duct panel (112), the exit frame (114) and the connection (116). The continuous exit section cooling channel (130) reduces the need for effusion channels in the transition duct. The continuous exit section cooling channel (130) further reduces costs and improves the emissions associated with the transition duct (100) of the gas engine turbine.

16 Claims, 3 Drawing Sheets

COOLING FEATURES FOR A GAS TURBINE ENGINE TRANSITION DUCT

BACKGROUND

1. Field

Disclosed embodiments are generally related to gas turbine combustors and, more particularly to the transition ducts of the gas turbine combustors.

2. Description of the Related Art

Gas turbine engines with can annular combustors have transition ducts to conduct and direct the gasses from the combustors to rows of turbine blades. The transition ducts as well as vanes orient, the combustion gas flow streams to contact the turbine blades at preferred angles for rotation of the blades.

In some gas turbine engines, the transition ducts have exit frames welded to the outlet of the transition duct. These transition ducts employ cooling features to keep them cooled during use. Typically separate cooling features are employed to cool the transition duct panels, the weld and the exit frame.

These multiple cooling features are time consuming to create and their implementations can increase the overall cost of the gas turbine component.

SUMMARY

Briefly described, aspects of the present disclosure relate to trailing edge ducts used with gas turbine combustors.

An aspect of the disclosure is a gas turbine engine having a transition duct having a transition duct panel, and an exit frame connected to the transition duct panel via a connection. A continuous exit section cooling channel is formed in the transition duct panel through the connection and further through the exit frame to an outlet located on a face of the exit frame.

Another aspect of the present invention is a method for forming a continuous exit section cooling channel for a gas turbine combustor. The method involves forming a transition duct panel channel in a transition duct panel. The method also involves connecting an exit frame to the transition duct panel; forming an outlet and an exit frame channel through the exit frame and a connection channel through the connection; and connecting the exit frame channel, the connection channel and the transition duct panel channel to form the continuous exit section cooling channel.

Still another aspect of the present invention is a transition duct having a transition duct panel; an exit frame connected to the transition duct panel via a connection; and a continuous exit section cooling channel formed in the transition duct panel through the connection and further through the exit frame to an outlet located on a face of the exit frame.

DETAILED DESCRIPTION

To facilitate an understanding of embodiments, principles, and features of the present disclosure, they are explained hereinafter with reference to implementation in illustrative embodiments. Embodiments of the present disclosure, however, are not limited to use in the described systems or methods.

The components and materials described hereinafter as making up the various embodiments are intended to be illustrative and not restrictive. Many suitable components and materials that would perform the same or a similar function as the materials described herein are intended to be embraced within the scope of embodiments of the present disclosure.

In some gas turbine engines the separate cooling features that are used are formed in multiple manufacturing processes. For example, the transition duct panels are cooled by forming channels in the transition duct panels. The transition duct panel channels that are formed are terminated prior to reaching the connection formed between the transition duct and the exit frame. Exit holes for the transition duct panel channels are drilled radially into the transition duct panel in order to provide an outlet for the transition duct panel channel.

Cooling for the exit frame is achieved by creating angled effusion holes that are connected to short exit frame channels. The exit frame channels also do not cross the connection formed between the transition duct and the exit frame.

Separately the connection between the transition duct panel and the exit frame is cooled by providing angled effusion holes in the connection. These separate cooling features are explained in further detail with reference to FIGS. 1A and 1B below.

Figure 1A:
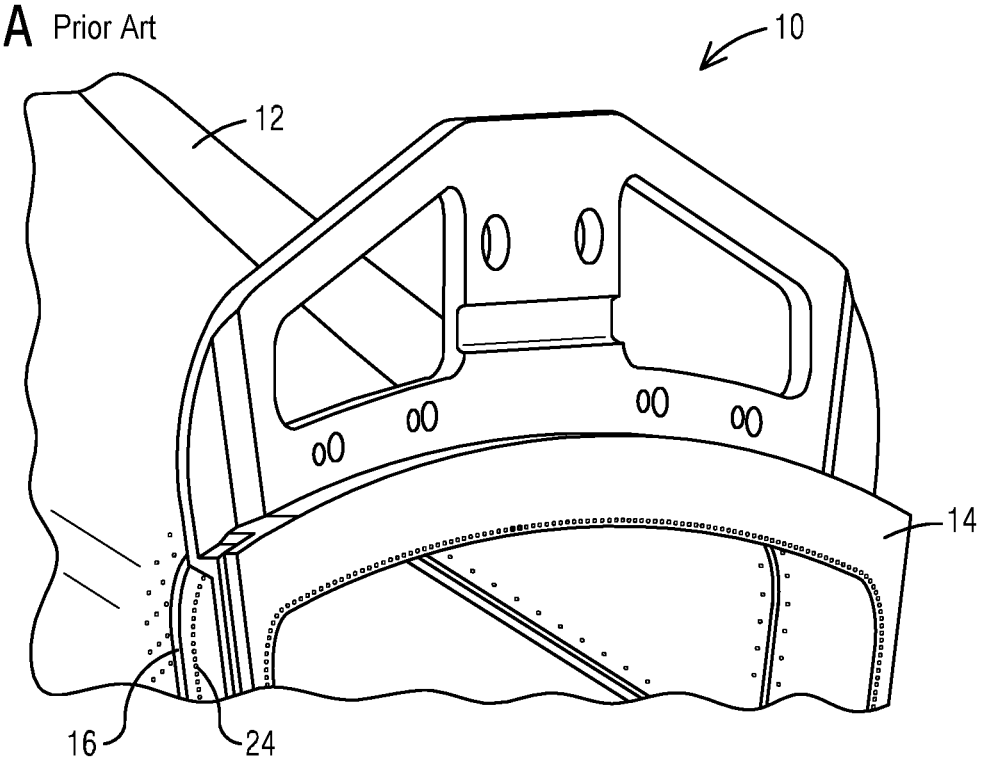
FIG 1A Prior Art
FIG. 1A shows a view of an exit section of a gas turbine engine.

FIG. 1A is a view of a transition duct 10 having a transition duct panel 12, an exit frame 14 and a connection 16 located between the exit frame 14 and the transition duct panel 12. The connection 16 is a weld.

Figure 1B:
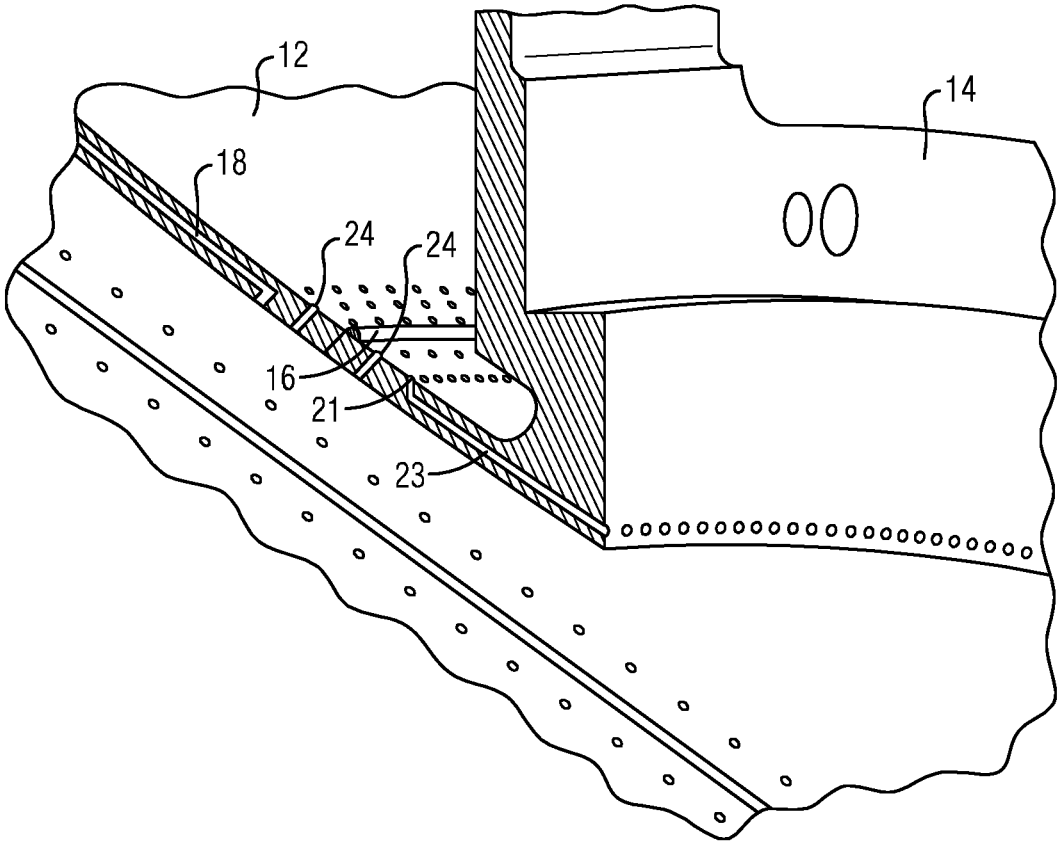
FIG 1B Prior Art
FIG. 1B shows a cut away view of a portion of the exit section of the gas turbine engine shown in FIG. 1A.

FIG. 1B shows a cutaway of the transition duct 10 shown in FIG. 1A. The cutaway view shows the cooling features employed in cooling the transition duct 10 of gas turbine engines. Formed in the transition duct panels 12 are transition duct panel channels 18 that terminate prior to reaching the connection 16. During manufacture of the transition duct panels 12, channel inlets and outlets are formed in the surface of the transition duct panel 12 and connected into the transition duct panel channel 18. This process can be is costly and time consuming.

In the exit frame 14, angled exit frame channel inlet holes 21 are connected to exit frame channels 23. The connection of the exit frame inlet holes 21 can also be a costly and time consuming process. Similar to the transition duct panel channels 18, the exit frame channels 23 do not cross the connection 16.

Separately from both the transition duct panel channels 18 and the exit frame channels 23, connection 16 is cooled by forming a number of angled connection effusion holes 24 into the connection 16. These holes are far less efficient than channel cooling.

Recognizing that measures can be taken to improve the cooling features of the transition duct a continuous exit section cooling channel 130 has been developed and is discussed below with respect to FIGS. 2A, 2B, 2C and 3.

Figure 2A:
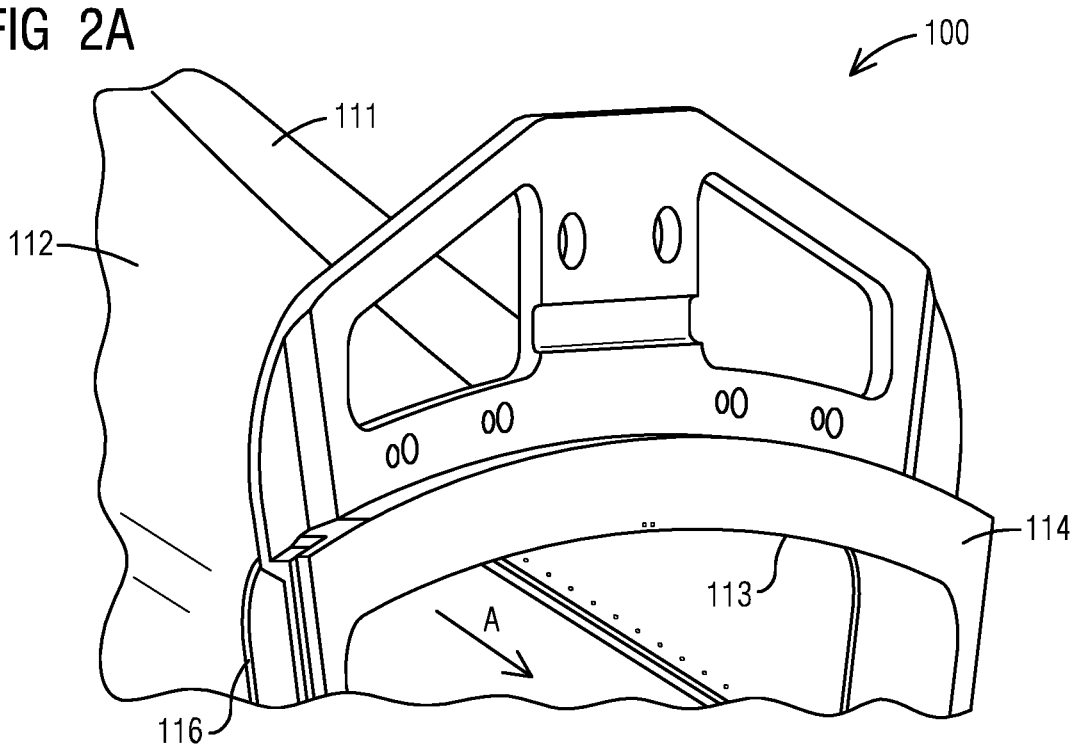
FIG. 2A shows a view of a transition duct exit section of a gas turbine engine in accordance with a disclosed embodiment.
Figure 2B:
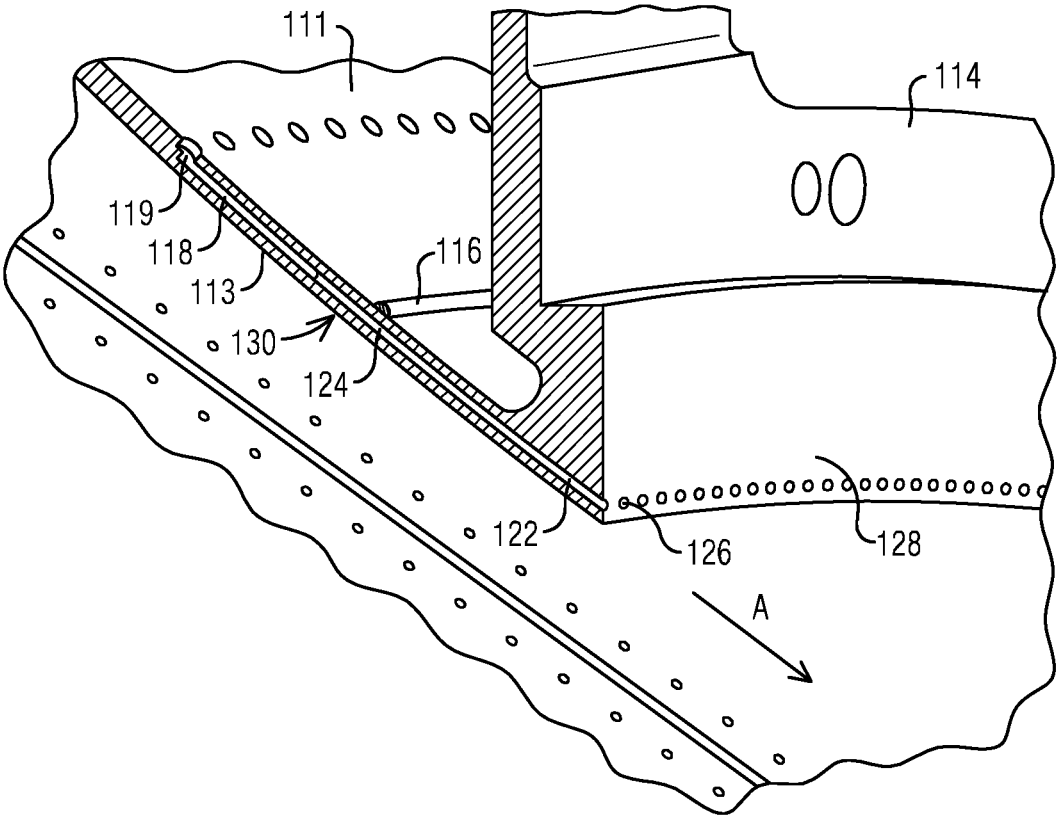
FIG. 2B shows a cutaway view of the transition duct exit section shown in FIG. 2A.
Figure 2C:
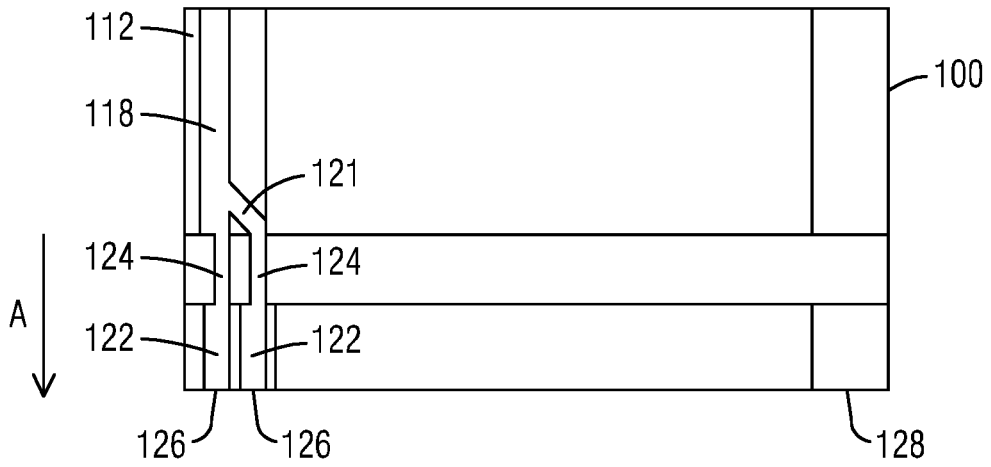
FIG. 2C shows a schematic top-down cut away view of transition duct having more than one continuous exit channel connected to a transition duct panel channel.
Figure 3:
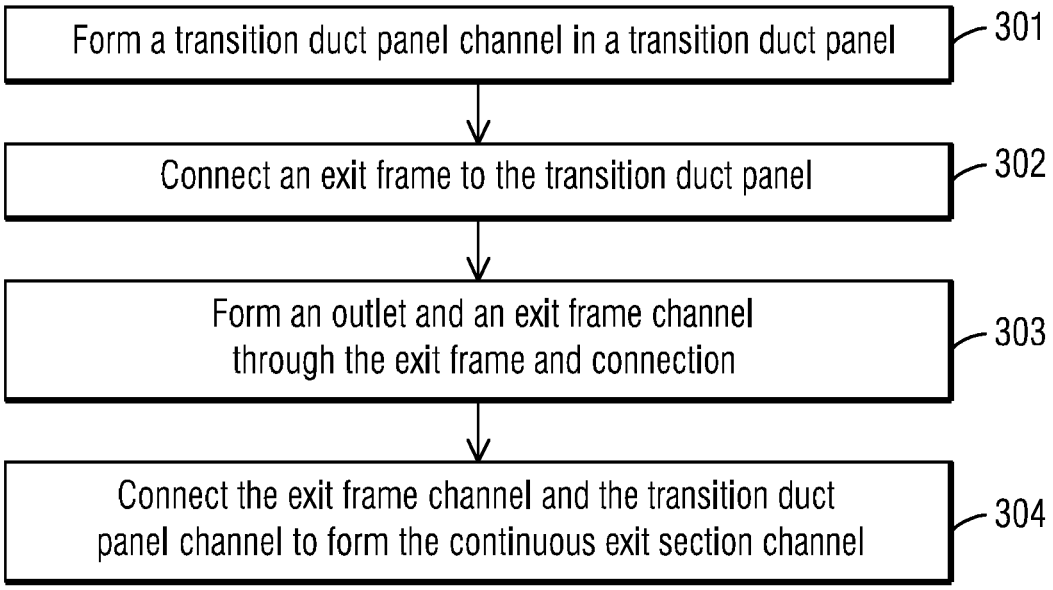
FIG. 3 is flow chart depicting the method of creating the contrinous exit section cooling channel.

Turning now to FIGS. 2A, 2B, 2C and 3, wherein an embodiment of the present invention is shown, and in particular to FIG. 2A where a view of the exit section of a transition duct 100 of a gas turbine engine is shown and FIG. 2B where a cutaway view of the transition duct 100 in FIG. 2A is shown. FIG. 2C is a top down cutaway view of an embodiment of the present invention. FIG. 3 is a flow chart that sets forth steps taken in forming a transition duct 100 in accordance with an embodiment of the present invention.

In FIG. 2A, a transition duct 100 having a transition duct panel 112, an exit frame 114 and a connection 116 is shown. The connection 116 may be a weld or brazed connection, or some other means to connection the transition duct panel 112 to the exit frame 114. The transition duct panel 112 has an outer surface 111 and an inner surface 113. The inner surface 113 is the surface of the transition duct panel 112 proximate to the flow of gases through the transition duct 100. The outer surface 111 is the surface of the transition duct panel 112 that is proximate to the exterior of the transition duct 100. The transition duct panel 112 may be one of a plurality of transition duct panels 112 that form the transition duct 100. The transition duct 100 is constructed from materials that are able to handle the heat and stresses that are associated with transition ducts in gas turbines engines. The transition duct 100 may transition from a cylindrical shaped, be rectangular shaped or take on a complex shape.

Turning to FIGS. 2B and 3, in step 301, formed in the transition duct panel 112 is a transition duct panel channel 118 that extends along the axial length A of the transition duct 100. The transition duct panel channel 118 is adapted to receive cooling fluids for cooling the transition duct 100 during operation. Transition duct panel channels 118 may be formed throughout the perimeter of the transition duct 100, wherein each of the transition duct panel channels 118 extend along the length of the transition duct 100. The transition duct panel channels 118 may be spaced equally or at variable intervals around the transition duct 100. The formed transition duct panel channels 118 are located between the outer surface 111 and the inner surface 113 of the transition duct panel 112. When formed, the transition duct panel channels 118 terminate just prior to the connection 116. A channel inlet 119 is also formed on the outer surface 111 of the transition duct panel 112 and connects to the transition duct panel channel 118 which lies within the transition duct panel 112.

In step 302, the exit frame 114 is connected to the transition duct panel 112 in order to form the connection 116. The connection may be achieved by welding or brazing the exit frame 114 to the transition duct panel 112. Connection of the transition duct panel 112 to the exit frame 114 is accomplished in an art recognized manner and secures the transition duct panel 112 to the exit frame 114. In the connection of the exit frame 114 to the transition duct 100 more than one transition duct panel 112 may be connected to the exit frame 114, by welding or brazing. The exit frame 114 connects the transition duct 100 to further components of the gas turbine engine.

In step 303, an outlet 126 is started at the exit frame face 128. The outlet 126 may be used to form an exit frame channel 122. The outlet may be formed by electro discharge machining (EDM). Alternatively the exit frame channel 122 may be pre-formed during the construction of the exit frame 114. The formed exit frame channel 122 is located within the exit frame 114. The exit frame channel 122 is then connected to a connection channel 124 that extends through the connection 116. This may be achieved by drilling or EDM. The exit frame channel 122 may be used in the formation of the connection channel 124. The connection channel 124 is sized to be connected to the transition duct panel channel 118. The embodiment shown in FIG. 2B has one exit frame channel 122 connected to one connection channel 124 and then connected to the transition duct panel channel panel 118. More than one exit frame channel 122 may be connected to one transition duct panel channel 118.

FIG. 2C shows a schematic cutaway view of an alternative embodiment in which a plurality of exit frame channels 122 are connected to one transition duct panel channel 118. In the embodiment shown each of the exit frame channels 122 that are connected to the one transition duct panel 118 are each connected to a connection channel 124, or used in the formation of the connection channel 124. The connection channels 124 then connect to the transition duct panel channel 118 at separate locations. In FIG. 2C one of the connection channels 124 is connected to the transition duct panel 118 via an angled channel 121 formed in the transition duct panel 112.

In step 304, the exit frame channel 122 and transition duct panel channel 118 are connected via a connection channel 124. The connection of the transition duct panel channel 118 and exit frame channel 122 through the connection channel 124 forms a continuous exit section cooling channel 130 extending from the transition duct panel 112 to the exit frame 114 that terminates at outlet 126. It should be understood that the continuous exit section cooling channel 130 is a continuous fluidly connected channel that permits the flow of the cooling fluids through the transition duct 100.

By forming a continuous exit section cooling channel 130 many of the cooling features that previously were implemented are replaced and/or supplemented by the continuous exit section cooling channel 130. This may save time previously used for forming effusion holes. This may be accomplished through the reduction of number of holes that are formed and the time involved in forming them. Additionally the continuous exit section cooling channel 130 may be dimensioned larger than previously used cooling features. For example a 0.8 mm-0.6 mm hole may be formed through a weld thickness of 5 mm and connected to a transition duct panel channel 118 that is 2 mm. The usage of larger holes formed during the formation process may make the formation of the continuous exit section cooling channel 130 easier than forming the cooling features used in previous transition ducts.

Additionally, because previously the cooling features that were implemented in the exit frame and the transition duct panel were separated, as much cooling fluid for cooling the transition duct panels would be needed to cool the exit frame. This could result in the usage of additional material. With the usage of a continuous exit section cooling channel 130 the same cooling fluid can be run through both the transition duct panel 112 and the exit frame 114. This can create high-efficiency cooling of the exit frame 114 and the connection 116 by using a reduced amount of material and potentially reducing emissions.

Also the continuous exit section cooling channel 130 allows elimination of weld-specific cooling features and permits a longer, more efficient, continuous exit section cooling channel 130 to cool the exit frame 114. The resultant efficiency of the continuous exit section cooling channel 130 is achieved with reduced costs in the manufacture of the gas turbine engine 100. By eliminating the effusion holes the compound angles and blind-hole intersections found in current designs may also be eliminated. For example, the transition ducts 100 shown in FIGS. 2A-2C have no connection effusion holes.

While embodiments of the present disclosure have been disclosed in exemplary forms, it will be apparent to those skilled in the art that many modifications, additions, and deletions can be made therein without departing from the spirit and scope of the invention and its equivalents, as set forth in the following claims.

What is claimed is:

1. A gas turbine engine comprising:

a transition duct having a transition duct panel, and an exit frame connected to the transition duct panel via a connection; and a continuous exit section cooling channel formed in the transition duct panel through the connection and further through the exit frame to an outlet located on a face of the exit frame, wherein the continuous exit section cooling channel comprises a transition duct panel channel, a connection channel and an exit frame channel, wherein the exit frame channel is connected to the connection channel, wherein the continuous exit section cooling channel further comprises a second exit frame channel connected to a second connection channel, and wherein the second connection channel is separate from the connection channel.

2. The gas turbine engine claim 1, further comprising a channel inlet formed within the transition duct panel and connected to the transition duct panel channel.

3. The gas turbine engine of claim 1, wherein the exit frame channel and the second exit frame channel are connected in fluid communication with the transition duct panel channel.

4. The gas turbine engine of claim 1, further comprising an angled channel formed within the transition duct panel connecting the second connection channel to the transition duct panel channel.

5. The gas turbine engine of claim 1, wherein a plurality of continuous exit section cooling channels are formed.

6. The gas turbine engine of claim 1, wherein the connection has no connection effusion holes.

7. A method for forming a continuous exit section cooling channel for a gas turbine combustor comprising:

forming a transition duct panel channel in a transition duct panel;

connecting an exit frame to the transition duct panel;

forming an outlet and an exit frame channel through the exit frame and a connection channel through the connection; and connecting the exit frame channel, the connection channel and the transition duct panel channel to form the continuous exit section cooling channel, wherein the continuous exit section cooling channel further comprises a second exit frame channel connected to a second connection channel, and wherein the second connection channel is separate from the connection channel.

8. The method of claim 7, further comprising forming a channel inlet within the transition duct panel and connecting the channel inlet to the transition duct panel channel.

9. The method of claim 7, wherein the exit frame channel and the second exit frame channel are connected to the transition duct panel channel.

10. The method of claim 7, further comprising forming an angled channel within the transition duct panel and connecting the second connection channel to the transition duct panel channel.

11. The method of claim 7, wherein a plurality of continuous exit section cooling channels are formed.

12. The method of claim 7, wherein the connection has no connection effusion holes.

13. A transition duct comprising:

a transition duct panel;

an exit frame connected to the transition duct panel via a connection; and a continuous exit section cooling channel formed in the transition duct panel through the connection and further through the exit frame to an outlet located on a face of the exit frame, wherein the continuous exit section cooling channel comprises a transition duct panel channel, a connection channel and an exit frame channel, wherein the exit frame channel is connected to the connection channel, wherein the continuous exit section cooling channel further comprises a second exit frame channel connected to a second connection channel, and wherein the second connection channel is separate from the connection channel.

14. The transition duct of claim 13, further comprising a channel inlet formed within the transition duct panel and connected to the transition duct panel channel.

15. The transition duct of claim 13, wherein the exit frame channel and the second exit frame channel are connected to the transition duct panel channel.

16. The transition duct of claim 13, wherein a plurality of continuous exit section cooling channels are formed.

* * * * *